United States Patent [19]

Blazek, Sr. et al.

[11] 4,146,465

[45] Mar. 27, 1979

[54] ADDITION OF OLEFINS TO CAT CRACKER FEED TO MODIFY PRODUCT SELECTIVITY AND QUALITY

[75] Inventors: James J. Blazek, Sr., Reisterstown; Ronald E. Ritter, Columbia, both of Md.

[73] Assignee: W. R. Grace & Co., New York, N.Y.

[21] Appl. No.: 876,712

[22] Filed: Feb. 10, 1978

Related U.S. Application Data

[63] Continuation-in-part of Ser. No. 814,075, Jul. 8, 1977, abandoned, which is a continuation of Ser. No. 706,019, Jul. 16, 1976, abandoned.

[51] Int. Cl.[2] ..... C10G 11/04; C07C 15/02; B01J 29/12

[52] U.S. Cl. ..... 208/120; 208/52 CT; 208/71; 208/103; 208/290; 252/411 R; 252/455 Z; 260/668 R; 260/673

[58] Field of Search ..... 208/120; 260/668

[56] References Cited

U.S. PATENT DOCUMENTS

| | | | |
|---|---|---|---|
| 2,626,233 | 1/1953 | Kimberlin et al. | 208/113 |
| 3,542,668 | 11/1970 | Pool | 208/67 |
| 3,630,886 | 12/1971 | Deed et al. | 208/96 |
| 3,758,400 | 9/1973 | Hampton | 208/72 |
| 3,788,977 | 1/1974 | Dolbear et al. | 208/120 |
| 3,954,600 | 5/1976 | Gladrow et al. | 208/119 |
| 3,974,062 | 8/1976 | Owen et al. | 208/74 |
| 3,974,063 | 8/1976 | Owen et al. | 208/74 |
| 4,002,557 | 1/1977 | Owen et al. | 208/120 |
| 4,035,285 | 7/1977 | Owen et al. | 208/120 |

*Primary Examiner*—Delbert E. Gantz
*Assistant Examiner*—G. E. Schmitkons
*Attorney, Agent, or Firm*—Arthur P. Savage

[57] ABSTRACT

A process for increasing the octane rating of gasoline and decreasing the quantity of coke produced by a catalytic cracking process by adding $C_2$ to $C_6$ linear olefins to the feed to the reactor with a zeolite containing cracking catalyst. The olefins may be added separately or mixed with the gas oil feed just before the oil preheat section ahead of the reactor.

6 Claims, No Drawings

ADDITION OF OLEFINS TO CAT CRACKER FEED TO MODIFY PRODUCT SELECTIVITY AND QUALITY

This application is a continuation-in-part of our application Ser. No. 814,075 filed July 8, 1977 which is a continuation of our Ser. No. 706,019 filed July 16, 1976, both now abandoned.

BACKGROUND OF THE INVENTION

In the catalytic cracking of gas oil, gasoline quality is currently controlled by primarily varying the catalyst activity and reactor operating conditions. Gasoline of relatively good octane quality, i.e. having a research clear octane rating of 91 to 93 can be made using these techniques.

The use of varying catalytic systems to improve the octane quality of the gasoline recovered from the cracking of hydrocarbons is disclosed in U.S. Pat. Nos. 3,788,977 to Dolbear et al., 3,830,725 to Dolbear et al. and 3,835,032 to Dolbear et al. These patents disclose the use of zeolite metals impregnated into or exchanged into the zeolite component of zeolite-promoted cracking catalysts to improve the octane content of the gasoline recovered from the cracking process. It is generally known that hydrocarbon cracking catalysts which are promoted with stabilized zeolites, particularly ion exchanged synthetic faujasite, are capable of producing high yields of gasoline fractions from petroleum feedstocks such as gas oil. These cracked gasoline fractions are subsequently combined with octane enhancing additives such as tetraethyl lead to produce high octane motor fuel.

Recent emphasis on air pollution control has dictated a need for removing metal-type octane enhancing additives from commercial gasolines. It is generally necessary for the refiner to use a blend of petroleum gasoline fractions which have an inherently high octane rating to produce non-lead gasoline of sufficient octane rating for use in modern automobile engines. Highly aromatic gasoline fractions are of particular use to the refiner. Unfortunately, however, the gasoline fractions produced by the catalytic cracking of gas oil using normal amorphous and crystalline zeolite type cracking catalysts are of relatively low aromatic content.

It has been reported in the literature [Van Hook, W. A. and Emmett, P. H.: Journal of Am. Chem. Society, 84, p. 4410 (1962)] that olefins react in a cracking atmosphere to polymerize, alkylate and/or cyclize to yield higher molecular weight hydrocarbons and even aromatics through a dehydrogenation step.

BRIEF DESCRIPTION OF THE INVENTION

We have found that if linear olefins in the $C_2$ to $C_6$ range are added to the feedstock of catalytic cracking units these olefins act to produce hydrocarbons in the gasoline range which are of high octane quality and improve the quality of the gasoline produced, and in addition the addition of olefins reduces the quantity of coke produced during the cracking reaction.

DETAILED DESCRIPTION OF THE INVENTION

The $C_2$ to $C_6$ olefins such as ethylene, propylene, butene and isobutene are added to the gas oil feed. The olefins are added separately and mixed with the gas oil feed just before the oil preheat section ahead of the reactor. The olefins are added in a concentration of about 5 to 35 weight percent of the total feed. The feed to these units is a conventional gas oil having a boiling point of from 600° to 975° F. Improved aromatic content, as evidenced by both the lower aniline point numbers (aniline point measurements decrease as aromatic content increases) and generally higher aromatic concentrations as measured by ASTM D-1319, result from operating the units at temperatures from 920° to about 950° F. and with catalyst to oil ratios of between 2 and 10 and preferably of between 2 to 4.5 pounds of catalyst per pound of oil, and a weight hourly space velocity of 20 to 60. The catalysts used are typically zeolite promoted cracking catalysts on a silica-alumina base. The bases may also contain substantial quantites of clay.

In performing a particularly preferred embodiment of our invention, the olefin is added to the gas oil feedstock in amounts which decrease the coke yield to a desireable level. In many commercial catalytic cracking operations the catalytic cracking process produces 6 to 8% by weight coke based on fresh feed. We have found that by adding olefins in amounts of about 5 to 35 weight percent of fresh feed, the coke yield may be reduced by up to about 50%, i.e. coke yields are decreased from a non-olefin addition level of about 6 to 8% down to a level of about 3 to 4%. Accordingly, by use of our process the refiner may add olefins in the amount required to obtain the coke yield necessary to maintain proper heat balance for the operation while at the same time minimizing the yield of non-productive coke. In addition, the added olefin results in the production of gasoline fractions of increased octane rating.

Our invention is illustrated by the following specific, but non-limiting, examples.

EXAMPLE 1

In this example, propylene was added to the gas oil feed. Propylene was mixed with the gas oil feed just before the oil preheat section ahead of the reactor. The catalyst was a synthetic $SiO_2/Al_2O_3$ gel matrix (30% $Al_2O_3$) promoted with 35 weight percent of a rare earth exchanged Y-type zeolite. The catalyst was deactivated by steaming at 1520° F. in a 20 weight percent steam in the air mixture for 12 hours prior to use in the reactor.

The reactor was operated at a temperature of 920° F., a catalyst to oil ratio of 2 and a weight hourly space velocity of 60. A typical West Texas heavy gas oil catalytic cracker feed was used as the base feedstock for these tests. The yield from the mixture of West Texas Gas Oil containing propylene and West Texas Gas Oil alone were compared. The data is set out in Table I below.

TABLE I

| | | | |
|---|---|---|---|
| Conversion | V % | 73.0(68.5)[1] | 69.5 |
| Hydrogen | W % FF | 0.009 | 0.014 |
| $C_1 + C_2$ | fresh feed | 0.69 | 0.77 |
| Total $C_3$'s | V % | 17.6 | 5.5 |
| $C_3^=$ | " | 15.7 | 4.2 |
| Total $C_4$ | V % FF | 8.2 | 7.7 |
| $C_4^=$ | " | 2.2 | 2.8 |
| $iC_4$ | " | 4.6 | 3.9 |
| $C_5^+$ Gasoline | V % FF | 55.5(63.5)[1] | 66.0 |
| $C_5^+$ Gaso./Conv. | 0.93[1] | 0.94 | |
| Octane No. | | | |
| F-1 | | 82.8 | 82.4 |
| F-1 + 3cc TEL | 92.9 | 92.5 | |
| F-2 | | 72.8 | 72.5 |
| F-2 + 3cc TEL | | 82.2 | 82.0 |
| Gravity | ° API | 55.6 | 56.3 |
| Aniline Pt. | ° F. | 95 | 102 |
| Bromine No. | | 38 | 38 |

TABLE I-continued

| | | | |
|---|---|---|---|
| Paraffin | V % | 58.8 | 60.7 |
| Olefin | V % | 8.3 | 11.1 |
| Aromatic | V % | 32.9 | 28.3 |
| Light Cycle Oil | V % FF | 10.3 11.2 | |
| Gravity | ° API | 21.8 | 22.0 |
| Aniline Pt. | ° F. | 75 | 93 |
| 640° F.+ Residue | | | |
| Gravity | ° API | 13.9 | 13.4 |
| Aniline Pt. | ° F. | 155 | 165 |
| Coke | W % FF | 1.2 | 2.4 |
| Total $C_3^=$ Added | W % | 9.0 | — |
| | gms | 70 | — |
| | V % of total feed | 15.5 | — |

[1]Based on conversion of only the West Texas Gas Oil portion of total feed.

It is apparent from the aniline point of the gasoline and the increase in aromatic content, based on ASTM D-1319 analysis, that the octane quality of the gasoline was improved. The increase in gasoline aromatic content is interpreted to be the result of propylene polymerization and cyclization into a $C_6$ naphthene followed by dehydrogenation to benzene or heavier aromatics. To some extent the lower coke yields, higher $C_4$ olefin yields, and higher aromatic content of the cycle oils (light cycle oil plus 640° F. residue) may be the result of the increased velocity through the reactor effected by increasing the feed volume with the propylene added. However, the increased velocity does not fully account for the 50% reduction in coke yield, i.e. 1.2 vs. 2.4%.

EXAMPLE 2

In this example the catalyst oil ratio was increased to 4.5 and the weight hourly space velocity was decreased to 35. The catalyst was the same as the catalyst used in Example 1 and it was pretreated in the same manner prior to use. The data collected in this run is set out in Table 2 below.

TABLE II

| | | | |
|---|---|---|---|
| Conversion | V % | 84.5(80.0)[1] | 81.0 |
| Hydrogen | W % FF | 0.012 | 0.017 |
| $C_1 + C_2$ | fresh feed | 0.95 | 1.16 |
| Total $C_3$'s | V % 22.9 | 8.9 | |
| $C_3^=$ | " | 16.9 | 5.9 |
| Total $C_4$ | V % FF | 14.6 | 14.4 |
| $C_4^=$ | " | 5.6 | 4.4 |
| $iC_4$ | " | 7.3 | 8.4 |
| $C_5^+$ Gasoline | V % FF55.0(68.5)[1] | 67.5 | |
| $C_5^+$ Gaso./Conv. | | 0.85[1] | 0.83 |
| Octane No. | | | |
| F-1 | | 85.0 | 84.3 |
| F-1 + 3cc TEL | | 93.0 | 93.6 |
| F-2 | | 75.0 | 74.2 |
| F-2 + 3cc TEL | | 84.4 | 83.6 |
| Gravity | ° API | 54.9 | 57.6 |
| Aniline Pt. | ° F. | 89 | 99 |
| Bromine No. | | 28 | 25 |
| Paraffin | V % | 62.8 | 64.8 |
| Olefin | V % | 8.4 | 2.8 |
| Aromatic | V % | 28.8 | 32.4 |
| Light Cycle Oil | V% FF | 7.1 | 8.4 |
| Gravity | ° API | 14.8 | 15.9 |
| Aniline Pt. | ° F. | 30 | 42 |
| 640° F.+ Residue | | | |
| Gravity | ° API | 3.8 | 5.5 |
| Aniline Pt. | ° F. | opaque | opaque |
| Coke | W % FF | 3.0 | 6.1 |
| Total $C_3^=$ Added | W % | 14.5 | — |
| | ams | 75 | — |
| | V % of total feed | 24.9 | — |

[1]Based on conversion of only the West Texas Gas Oil portion of total feed.

It is apparent that increasing the catalyst oil ratio and decreasing the space velocity caused a 10 point decrease in the aniline point of the gasoline product and in the light cycle oil product. As in Example 1 the coke was decreased substantially in this run.

EXAMPLE 3

In this example a catalyst consisting of 30% clay, 15.6% rare earth exchanged faujasite and 54.4% synthetic amorphous silica alumina cracking catalyst having an alumina content of about 30% was used as the catalyst. The unit was operated at a temperature of 920° F., a catalyst oil ratio of 4 and a weight hourly space velocity of 20. The cracking characteristics of a West Texas Gas Oil containing 25.1% of propylene were compared with the cracking characteristics of a West Texas Gas Oil without the addition of propylene. The data collected is set out in Table III below.

TABLE III

| | | | |
|---|---|---|---|
| Conversion | V % | 86.0(81.0)[1%] | 82.0 |
| Hydrogen | W % FF | 0.019 | 0.02 |
| $C_1 + C_2$ | fresh feed | 1.36 | 1.51 |
| Total $C_3$'s | V % 26.6 | 9.3 | |
| $C_3^=$ | 41 | 18.4 | 7.5 |
| Total $C_4$ | V % FF | 13.2 | 12.0 |
| $C_4^=$ | " | 5.0 | 4.0 |
| $iC_4$ | " | 6.9 | 6.8 |
| $C_5^+$ Gasoline | V % FF | 53.0(71.0)[1] | 70.5 |
| $C_5^+$ Gaso./Conv. | | 0.87[1] | 0.85 |
| Octane No. | | | |
| F-1 | | 89.6 | 88.2 |
| F-1 + 3cc TEL | | 96.5 | 95.9 |
| F-2 | | 77.6 | 76.8 |
| F-2 + 3cc TEL | | 84.6 | 84.0 |
| Gravity | ° API | 53.6 | 55.9 |
| Aniline Pt. | ° F. | 80 | 90 |
| Bromine No. | | 34 | 30 |
| Paraffin | V % | 51.8 | 59.6 |
| Olefin | V % | 9.3 | 6.6 |
| Aromatic | V % | 38.9 | 33.8 |
| Light Cycle Oil | V % FF | 5.8 | 7.1 |
| Gravity | ° API | 16.7 | 12.3 |
| Aniline Pt. | ° F. | 46 | 34 |
| 640° F.+ Residue | | | |
| Gravity | ° API | 4.2 | 5.9 |
| Aniline Pt. | ° F. | 125 | 135 |
| Coke | W % FF | 2.4 | 4.9 |
| Total $C_3^=$ Added | W % | 14.7 | — |
| | gms | 125 | — |
| | V % of total feed | 25.1 | — |

[1]Based on conversion of only the West Texas Gas Oil portion of total feed.

It is apparent from these data that the use of a different catalyst gave satisfactory results. The aniline point of the gasoline decreased by 10 points and the coke make decreased by about 50% as in the runs described in Example 1 and 2. Additionally, gasoline octanes (Research and Motor clear (no lead) were up substantially (1.4 and 0.8, respectively) as a result of increased aromatic content due to propylene, cyclization and dehydrogenation.

We claim:

1. In a process for catalytically cracking hydrocarbons wherein a gas oil feedstock is contacted with a rare earth exchanged faujasite zeolite promoted cracking catalyst at a temperature of about 700° to 1200° F. to produce gasoline fractions and coke; the improvement comprising; adding to the gas oil feedstocks from about 5 to 35 weight percent of a linear olefin having 2 to 6 carbon atoms, said olefin being added in amounts required to reduce the coke produced during said process to a desired level of up to about 50% less than obtained without olefin addition and to simultaneously increase the octane rating of said gasoline fractions, whereby said olefin is added in amounts required to obtain the coke yield necessary to maintain proper heat balance for said process while at the same time sufficient to minimize the yield of non-productive coke.

2. The process of claim 1 wherein the catalyst contains up to 35 weight percent of a rare earth exchanged faujasite.

3. The process of claim 1 wherein the weight hourly space velocity within the cracking zone is 20 to 60.

4. The process of claim 1 wherein the catalyst to oil ratio ranges between 2 to 1 and 10 to 1.

5. The process of claim 1 wherein the olefin is selected from the group consisting of ethylene, propylene and butene.

6. The process of claim 1 wherein said olefin is propylene.

* * * * *